US010926846B2

(12) United States Patent
Miller

(10) Patent No.: US 10,926,846 B2
(45) Date of Patent: Feb. 23, 2021

(54) RESILIENTLY FLEXIBLE FIN

(71) Applicant: Flying Fin Systems Pty Ltd, Margaret River (AU)

(72) Inventor: Glenndin George Miller, Margaret River (AU)

(73) Assignee: Flying Fin Systems Pty Ltd, Margaret River (AU)

( * ) Notice: Subject to any disclaimer, the term of this patent is extended or adjusted under 35 U.S.C. 154(b) by 231 days.

(21) Appl. No.: 16/089,406

(22) PCT Filed: Mar. 28, 2017

(86) PCT No.: PCT/AU2017/050268
§ 371 (c)(1),
(2) Date: Sep. 28, 2018

(87) PCT Pub. No.: WO2017/165915
PCT Pub. Date: Oct. 5, 2017

(65) Prior Publication Data

US 2020/0298937 A1 Sep. 24, 2020

(30) Foreign Application Priority Data

Apr. 1, 2016 (AU) ..... 2016901221
Nov. 28, 2016 (AU) ..... 2016904890

(51) Int. Cl.
*B63B 32/66* (2020.01)
*B63B 1/24* (2020.01)
*B63B 35/00* (2020.01)

(52) U.S. Cl.
CPC ..... *B63B 32/66* (2020.02); *B63B 1/242* (2013.01); *B63B 1/248* (2013.01); *B63B 2035/009* (2013.01)

(58) Field of Classification Search
CPC ..... B63B 32/66; B63B 1/242; B63B 1/248; B63B 2035/009
See application file for complete search history.

(56) References Cited

U.S. PATENT DOCUMENTS 4,733,496 A * 3/1988 Wallner ..... B63B 32/66 441/79
2008/0261470 A1* 10/2008 Jones ..... B63B 32/60 441/79

FOREIGN PATENT DOCUMENTS

EP 0079113 A1 * 5/1983 ..... B63B 3/38
WO WO-9219492 A1 * 11/1992 ..... B63B 32/60

* cited by examiner

*Primary Examiner* — Stephen P Avila
(74) *Attorney, Agent, or Firm* — Patshegen IP LLC; Moshe Pinchas

(57) ABSTRACT

The present invention relates to a resiliently flexible fin for a surfboard or another surface watercraft, the resiliently flexible fin comprising a titanium or titanium alloy core and an opening in the trailing edge that enables a portion of the rear of the fin to resiliently flex against the force of water as the surfboard is turned, which can generate additional forward thrust for the surfboard as the surfboard exits the turn and the fin returns to its unflexed state displacing water in its path with force.

14 Claims, 16 Drawing Sheets

A

B

RESILIENTLY FLEXIBLE FIN

TECHNICAL FIELD

The present invention relates to a resiliently flexible fin for a surfboard comprising a titanium or titanium alloy core, and an opening in the trailing edge that enables a portion of the rear of the fin to resiliently flex against the force of water as the surfboard is turned, which generates forward thrust for the surfboard as the surfboard exits the turn and the fin returns to its unflexed state displacing water in its path with force.

BACKGROUND ART

The following discussion of the background art is intended to facilitate an understanding of the present invention only. The discussion is not an acknowledgement or admission that any of the material referred to is or was part of the common general knowledge as at the priority date of the application.

A surfboard, stand-up paddleboard (SUP), or similar type of board for use in water sports and other activities can be viewed in one sense as a summation of hydrodynamic surfaces. The surface of the bottom of the board in contact with water generates lift and affects speed. More importantly though, it is the fins working in collaboration with rail and bottom contour that most influence the feel of the board when changing direction. Since the form shape of surfboards including the rails and bottom surface has undergone finer and finer adjustments over the past few decades, the largest gains that can still be made to a board's performance is in fin modification.

Predominant factors that influence the effect of the fins include (i) foil shape, and the curve from leading to trailing edge as it changes from base to tip; (ii) template shape, which is the combination of depth, width, and rake that make up the profile of the fin; and (iii) fin placement, which comprises tow and camber of the fins, the distance between the fins, and the distance of the fins from the rear of the board.

Foils comprise surfaces which affect lift and drag. Where one surface of a foil is curved and the other, predominantly flat (a 'flat foil'), it takes less effort (drag) for liquid to flow past the flat surface as the path of least resistance than the curved surface. As a result, more water will flow past the flat surface of the foil creating an area of high pressure. Conversely, an area of low pressure is created adjacent to the curved surface of the foil. This difference in pressure creates lift towards the curved side of the foil. The more curve a foil has, the more drag it induces over the curved surface which means that a foil with greater curvature will have more lift at lower speeds. The problem is at higher speeds that additional drag will develop turbulence and stall the flow across the foil. Side fins on a surfboard are usually flat foils which are oriented with the flat face of the foil facing towards the centre or stringer of the board. The resulting pressure differential assists to pull the board fins and rail of the surfboard down into the water. Therefore, thicker, more curved foils are preferred by surfers for slow waves, and flatter, finer foils for faster waves.

Template shape affects stability and control. The template of the fin is usually considered as the overall shape of the fin from a side view. As an example, fins that are deeper, with a wider base and more rake provide greater stability and control as a result of a relatively large surface area. However, more surface area causes greater drag and slows a board down. As a generalisation known amongst surfers, fins with a greater surface area are more preferred for steep and heavy waves, choppy and irregular conditions, for heavier surfers, and/or surfers with a flowing style. Alternatively, fins with less surface area are more preferred for sloped, clean and glassy waves, for lighter surfers, and/or surfers that exercise extreme and radical manoeuvres.

'Toe' can be considered in terms of the angle the base of the side fins are pointed in towards the centre of the board relative to the leading edge and trailing edge at the base. 'Cant' can be considered in terms of the angle the body of a fin is set at relative to the bottom surface of the board in a plane perpendicular to the direction of the stringer. Both toe and cant affect the 'angle of attack' of fin foils in their movement through the water. A greater angle forces more water flow around the outside curved surface of the foil at lower speeds making it easier to initiate turns on slower waves. However, too much angle at higher speeds increases turbulence and drag reducing the speed of the board.

The flex of a surfboard fin can affect stability in turns. For example, a flexible tip on a fin can dampen or smooth out some of the bite when a surfer changes direction on a surf board. But a stable fin base is considered crucial to prevent or minimise turbulence which can generate drag and disturb the lift causing loss of fin control, making the board slow and out of control.

Modern surfing is becoming more and more focused on aerial manoeuvres or at least hard turns on the lip of the wave, particularly in competitions where they are given higher score weightings. However, the speed required to lift a 60 to 90 kg surfer on their shortboard above the wave for sufficient time to pull off an aerial manoeuvre is significant, and this is usually following a hard 'bottom' turn where the board is directed up toward and past the lip of the wave.

Board speed can be lost during that bottom turn as the board turns away from the direction of the force of the wave which was propelling the board forward. This lost speed can then limit the surfer in terms of the possible manoeuvres they can attempt at the lip or above the wave depending on the ensuing speed following the turn.

SUMMARY OF THE INVENTION

First Aspect of the Invention

In a first aspect, the invention provides a resiliently flexible fin comprising:

- two outer fin surfaces which meet at a leading edge and a trailing edge;
- a mounting means for mounting the fin onto a surfboard;
- a core comprising metal or metal alloy;
- a flexible cover over at least a portion of the core; and
- an opening at the trailing edge through a portion of the fin.

In a preferred embodiment, the metal is titanium and the metal alloy is titanium metal alloy.

The opening at the trailing edge through a portion of the fin section is preferably a cut. For the purpose of describing the invention according to the different aspects herein, a 'cut' also includes a slit, tear, slot, incision or other similar types of openings that can be formed or created in a fin. More preferably the cut is a substantially lateral cut. That is, the cut will be substantially straight, and preferably parallel to the mounting means, and/or the bottom surface of a surfboard to which the fin is mounted. Alternatively, the cut may comprise a curve. The width of the cut in a preferred embodiment is between approximately 0.1 and 10 mm wide and may vary or be consistent through the length of the cut.

More preferably, the cut is between approximately 1 and 5 mm wide. The cut is preferably through approximately half the fin from trailing edge towards the leading edge, and the diameter or height of the cut preferably increases towards the trailing edge. The opening or cut is preferably through a portion of the core which assists the portion of the core on the opposite side of the opening to the mounting means to resiliently flex. At least one of the edges of the cut may comprise chamfers, for example, to reduce sharp edges.

The position of the opening or cut is preferably near to, or adjacent, the mounting means. This enables a larger portion of the fin on the opposite side of the opening to the mounting means to resiliently flex when forces of water are exerted on an outer fin surface of the fin.

The titanium alloy comprises between approximately 3.5% to 4.5% vanadium, and between approximately 5.5% to 6.75% aluminium. This titanium alloy at a thickness and shape suitable for a conventional surfboard fin has been shown to flex from the force of water exerted on it during a turn by a surfboard to which a fin comprising the titanium alloy is mounted, and resiliently return to its non-flexed configuration once the surfboard exits the turn.

The core preferably comprises apertures, recesses, and/or cavities, and the flexible cover, for example, a flexible overmoulding, preferably fills at least some of the apertures, recesses, and/or cavities providing strong attachment between core and flexible cover.

The mounting means are preferably mounting blocks capable of attaching to commercially available fin plug and fin box systems or other mounting means described herein or depicted in the figures.

In use, forces exerted by water on an outer fin surface when a rider of a surfboard on which the fin is mounted forces the surfboard to turn while riding a wave, preferably flexes the portion of the fin on the opposite side of the opening to the mounting means, and upon release of the force exerted by the water as the surfboard exits the turn, the resilience of the metal or metal alloy core, preferably titanium or titanium alloy core, displaces water in its path with force as it returns the fin to its non-flexed configuration providing additional forward thrust for the surfboard.

The resiliently flexible fin may additionally comprise a fin section releasably or permanently attached to a fin base portion, wherein the fin section comprises the opening and the fin base portion comprises the mounting means for mounting the fin onto a surfboard.

Benefit of the Invention

In finding a solution to the problem of lost speed during the turning of a surfboard, the inventor focused on the fins of the board as they hold the board on its line (including with a rail of the board) during a turn. By creating a "hinged door-like effect", the rear portion of the resiliently flexible fin of the invention can flex with the force of the water during a hard turn, and then resiliently return to its original position and briefly beyond with force, causing pressure back against the water upon exit of the turn to displace water with force therein propelling the board forward. Thus, rather than losing speed or even maintaining current speed through and past the turn, the resiliently flexible fin of the invention can potentially generate additional speed for the board.

To enable this fin portion to return to its original position with force with each turn without breaking, titanium alloy as used in the aeronautics industry was employed. This titanium alloy was found to possess a flexibility, resilience, weight, and strength that can flex to absorb turning forces applied by a surfer, and then return to the rest position and even briefly beyond towards the end of the turn to release the stored energy. This release of stored energy from the flex and return of the titanium alloy to its original position can increase the speed of the board ridden by a surfer up toward the steepest section of a wave and airborne beyond the lip. The resilience characteristics of titanium alloy are such that it can flex in this manner hundreds of times without losing any flexibility or permanently deforming, it can maintain its potential to store the same degree of energy while flexing during each turn, it can be made considerably thinner than normal surfboard fins, and does not break down like common materials used in surfboard fins such as fibreglass, plastic or polycarbonate, and does not corrode in salt water.

Safety concerns required the inventor to cover the thin titanium alloy fins with overmoulding to avoid potential cuts and gashes to the surfer and others nearby. However, it was further discovered that the 'hinge door' effect worked to even greater effect with more energy released if the flexing rear portion of the fin comprised the over-coating and a lesser portion of titanium alloy.

Such were the forces generated by this resiliently flexible fin of the invention that a sufficiently strong fin base was required in the same or a material of similar strength to prevent the forces being generated during a turn from simply snapping the flexible fin from the surfboard.

In testing fins of the invention with existing standard thruster shortboard fins as controls, expert and former professional surfers anecdotally commented that additional speed out of turns was very noticeable and even allowed them the benefit of sharper turns than was possible with the standard fins.

Second Aspect of the Invention

In a second aspect, the invention provides a resiliently flexible fin for use on a surfboard, the fin comprising:

a fin section comprising
- a core comprising titanium or titanium alloy;
- a flexible over-moulding covering at least a portion of the core,
- the core and over-moulding forming two outer fin surfaces which meet at a leading edge and a trailing edge; and
- at least one opening at the trailing edge through a portion of the fin section forming two or more resiliently flexible flaps, wherein the fin comprises mounting means for mounting the fin to a surfboard.

In a preferred embodiment, the resiliently flexible fin of the invention comprises at least a separate flexible fin section and a fin base which, when attached, form the resiliently flexible fin. An advantage being that during manufacture of resiliently flexible fins of the invention, a variety of fin sections having different templates and other characteristics may be attached to the same fin base configuration, therein potentially reducing manufacturing costs and enabling fin sections and fin bases to be manufactured by the same or different manufacturers. A fin section may be permanently attached to a fin base or releasably attached to a fin base. Thus, the invention further provides:

a flexible fin section comprising:
- a core comprising titanium or titanium alloy;
- a flexible over-moulding covering at least a portion of the core, the core and over-moulding forming two outer fin surfaces which meet at a leading edge and a trailing edge; and at least one opening at the trailing edge through a portion of the fin section forming two or more resiliently flexible portions or flaps.

wherein the fin section can be attached to a fin base for mounting to a surfboard.

The at least one opening at the trailing edge through a portion of the fin section is preferably a cut through the fin section. For the purpose of describing the invention according to the different aspects herein, a 'cut' also includes a slit, tear, slot, incision or other similar types of openings that can be formed or created in a fin section to enable the formation of a flap at the trailing edge. The cut is more preferably a lateral, substantially straight cut that, when the resiliently flexible fin is mounted to a surfboard, lies substantially parallel to the bottom surface of the surfboard. Alternatively, the cut may be curved. The width of the cut in a preferred embodiment is between approximately 0.1 and 10 mm wide. More preferably, the cut is between approximately 1 and 3 mm wide.

The length of an opening may vary depending on the composition and materials used in the fin section and the desired flexibility and size of the resiliently flexible flaps in the trailing edge. An opening preferably passes through a portion of the overmoulding and also a portion of the core.

A plurality of flaps may be formed by the at least one opening. Preferably, three openings in the form of cuts beginning at the trailing edge form two flaps in addition to the tip of the fin section.

The inventor discovered that titanium and titanium alloy has the sufficient flexibility, strength, weight, and resilience for use in the core of the resiliently flexible fin of the invention. That is, a key requirement for the core is a thickness less than the common thickness of a surfboard fin (and preferably less) and at this width, the core must be sufficiently flexible for the flaps at the trailing edge to bend against the forces exerted on the fin by water during use on a turning surfboard. At the same time, the flaps require sufficient strength and resilience to return to the original position hundreds of times without deforming or breaking while forcing water back at a speed sufficient to provide additional speed of the surfboard and rider in a substantially forward direction when exiting a turn. Thus, the invention may also comprise a core made from a metal other than titanium, or another material with these or similar characteristics of flexibility, resilience, weight and strength and incapable of rusting or significant corrosion.

The core preferably comprises holes or cavities. These holes and/or cavities are preferably filled with overmoulding which assists attachment of the overmoulding to the core.

An important characteristic of the overmoulding is that it can attach to the core, and particularly titanium or titanium alloy and not separate during normal use of the resiliently flexible fin or fin section of the invention while in normal use on a surfboard. The overmoulding preferably covers the entire core except where the core attaches to the fin base or mounting means. The overmoulding may comprise a variety of different colours and may be opaque, or substantially clear so that the core is viewable.

The invention provides a resiliently flexible fin for mounting to, and use on a surfboard, the fin comprising a fin section and fin base as herein described. The invention further provides a resiliently flexible fin as herein described, mounted to a surfboard, wherein in use, a rider forcing the surfboard to turn causes at least the flaps in the trailing edge to flex against the force of the water, with the resilience of the flaps forcing the flaps towards their un-flexed position toward the end of the turn and as the rider exits the turn, therein providing additional propulsion of the surfboard in a substantially forward direction towards the front of the surfboard.

Third Aspect of the Invention

In a third aspect of the resiliently flexible fin of the invention, a second fin section is attached to the resiliently flexible fin according to the first aspect or second aspect, or a resiliently flexible fin section according to the first aspect or the second aspect, the second fin section comprising two outer fin surfaces which meet at a leading edge and a trailing edge.

The second fin section is preferably attached to the fin section/fin by one or more attachment means. Attachment means may, in some non-limiting examples, comprise rods, plates, pins, bars, and/or be formed from a portion of either the fin section/fin or the second fin section. More preferably, the one or more attachment means comprise one or more screws. Even more preferably, the one or more attachment means comprise three sets of two closely related screws. The one or more attachment means preferably preserve a minimum distance between the fin section/fin and the second fin section of between approximately 0.1 mm and 5 mm. The one or more attachment means preferably preserve a minimum distance between the fin section/fin and the second fin section of between approximately 0.25 mm and 1.5 mm. The one or more attachment means more preferably preserve a minimum distance between the fin section/fin and the second fin section of approximately 1 mm. The attachment means preferably reduce or remove any fluttering effect on either fin section caused by water passing around and between the fin section/fin and the second fin section.

The second fin section is preferably positioned substantially parallel to the fin section/fin and may be offset such that the leading edge of the second fin section is not aligned with the leading edge of the fin section/fin. The fin section/fin preferably comprises a flat foil having a substantially flat outer fin surface, and a curved outer fin surface. The second fin section may also comprise a flat foil having a substantially flat outer fin surface, and a curved outer fin surface. Alternatively, the second fin section may comprise two flat outer fin surfaces. In a preferred embodiment, the substantially flat outer fin surface of the fin section/fin and a substantially flat outer fin surface of the second fin section substantially face the same direction. Preferably, the template of the second fin section comprises only a portion of the size of the curved leading edge of the fin section/fin.

The second fin section preferably comprises at least one passage through which water can pass. The passage comprises an opening on each outer fin surface of the second fin section through which water can enter and exit. The passages may be created from drilling or cutting holes or perforations through the second fin section or from the shape of a mould used to make the fin section.

A resiliently flexible dual fin according to this embodiment of the invention is preferably mounted in the position of a side fin on a surfboard wherein:

the fin section/fin comprises a flat foil having a substantially flat outer fin surface facing the centre line or stringer of the surfboard, and a curved outer fin surface facing the adjacent rail of the surfboard; and the fin section/fin is in a position closer to the adjacent rail of the surfboard than the second fin section.

Two or more resiliently flexible dual fins according to the third aspect of the invention may be mounted to a surfboard.

The second fin section may be the same size or a different size to the fin section/fin. The second fin section may have a different fin template to the fin section/fin. Preferably, the second fin section is the same or a similar size longitudinally as the size and template of the fin section/fin with a similarly shaped leading edge. More preferably, the lateral width of the second fin section between the leading and trailing edge is shorter than the same measurement of the fin section/fin.

Mounting Means

The mounting means for a resiliently flexible fin of the invention according to an aspect as herein described may comprise a variety of means known for mounting or attaching a fin to a surfboard.

In a preferred embodiment, the mounting means comprises one or more mounting blocks for attaching to one or more surfboard fin plugs and/or fin boxes. The one or more mounting blocks are preferably compatible with, and capable of attaching to commercially available fin plug and/or fin box systems. Preferably, the one or more mounting blocks can be mounted to commercially available FCS® fin plugs and/or Futures® fin boxes.

In another preferred embodiment, the mounting means comprises a base attachment surface and an adhesive wherein the adhesive directly and fixedly secures the base attachment surface to the external bottom surface of the surfboard. The adhesive can maintain an adhesive connection between a resiliently flexible fin of the invention and a surfboard, particularly when exposed to water. Preferably, one or more screws additionally secure the adhered base attachment surface to the surfboard.

Board Type

The resiliently flexible fin of the invention according to an aspect as herein described may be mounted to any one of the boards in the group comprising: surfboard, shortboard, kneeboard, longboard, minimal, soft board, kiteboard or a board used for kite surfing, wind surfer, stand up paddleboard, wakeboard, rescue board, bodyboard, or another board used in surface water sports or activities. Importantly, reference herein to a 'surfboard' is also meant to include reference to any one of these other boards.

Fin Arrangement

More than one resiliently flexible fin of the invention according to an aspect as described herein may be mounted to a surfboard. For example, a thruster fin setup on a surfboard may comprise up to three resiliently flexible fins of the invention as described herein.

Various combinations are possible for using various embodiments of resiliently flexible fins of one or more aspects of the invention as described herein, exclusively, or in combination with non-flexible or other types of fins on a surfboard.

Process for Mounting a Fin of the Invention

The present invention further provides a process of mounting a resiliently flexible fin of the invention according to an aspect as herein described, to any one of the boards in the group comprising: surfboard, shortboard, kneeboard, longboard, minimal, soft board, kiteboard, wind surfer, stand up paddleboard, wakeboard, rescue board, bodyboard, or another board used in surface water sports or activities.

Process for Manufacturing a Fin of the Invention

The present invention also provides a process of manufacturing a resiliently flexible fin of the invention or a fin section of a resiliently flexible fin of the invention according to any of the aspects as described herein.

In a preferred embodiment of the invention, part of, or the entire fin base, and/or bottom portion of the resiliently flexible fin and mounting means are constructed from, or comprise, a metal or a metal alloy, and preferably titanium or titanium alloy. The benefit of the use of titanium or titanium alloy in the base and/or in the mounting means is to prevent a weakness in the resiliently flexible fin which can break during the flexing of the core and the trailing edge flaps against the force of the water. Much of the force on the resiliently flexible fin when flexing under the force of water is concentrated toward the leading edge near the base of the fin. The strength provided by titanium or titanium alloy at this point can withstand those forces with each turn of the surfboard on which the resiliently flexible fin is mounted.

Thus, the invention may also comprise a core made from a metal other than titanium, or another material with these or similar characteristics to titanium or titanium alloy of flexibility, resilience, weight and strength and incapable of rusting or significant corrosion.

In a preferred embodiment, the titanium alloy is Titanium Alloy Ti 6Al-4V such as produced by Carpenter® which comprises approximately 6% aluminium and 4% vanadium. More preferably, the titanium alloy comprises between approximately 3.5% to 4.5% vanadium, and between approximately 5.5% to 6.75% aluminium. In another embodiment, the entire fin of the invention is made of metal, for example titanium or titanium alloy.

The overmoulding may comprise a variety of different materials that have already been used to construct surfboard fins, or comprise materials unique to surfboard fin manufacture. In a preferred embodiment, the overmoulding comprises a soft type polymer. In some non-limiting examples, the overmoulding may comprise one or more compounds from the following group: thermoplastic elastomers, which includes styrenic block copolymers (TPE-s), thermoplastic olefins (TPE-o), elastomeric alloys (TPE-v or TPV), thermoplastic polyurethanes (TPU), thermoplastic copolyester, thermoplastic polyamides, or thermally conductive epoxy. Primers and/or adhesives may be used to assist the bonding of the overmoulding to the titanium or titanium alloy. However, current available overmoulding techniques generally no longer require the use of primers or adhesives.

An important characteristic of the overmoulding is that it can attach to the core, and particularly titanium or titanium alloy and not separate during normal use of the resiliently flexible fin or fin section of the invention while in normal use on a surfboard. The core preferably comprises holes, recesses, and/or cavities. These holes, recesses, and/or cavities are preferably filled with overmoulding which assists attachment of the overmoulding to the core. The overmoulding preferably covers the entire core except where the core attaches to the fin base or mounting means. The overmoulding may comprise a variety of different colours and may be opaque, or substantially clear so that the core is viewable.

DESCRIPTION OF PREFERRED EMBODIMENTS

Those skilled in the art will appreciate that the invention described herein is susceptible to variations and modifications other than those specifically described. It is to be understood that the invention includes all such variations and modifications. The invention also includes all of the steps, features, compositions and compounds referred to or indicated in the specification, individually or collectively and any and all combinations or any two or more of the steps or features.

The present invention is not to be limited in scope by the specific embodiments described herein, which are intended for the purpose of exemplification only. Functionally equivalent products, compositions and methods are clearly within the scope of the invention as described herein.

Throughout this specification, unless the context requires otherwise, the word "comprise", or variations such as "comprises" or "comprising", will be understood to imply the inclusion of a stated integer or group of integers but not the exclusion of any other integer or group of integers.

Other definitions for selected terms used herein may be found within the detailed description of the invention and apply throughout. Unless otherwise defined, all other scientific and technical terms used herein have the same meaning as commonly understood to one of ordinary skill in the art to which the invention belongs.

Features of the invention will now be discussed with reference to the following preferred embodiments.

First Aspect of the Invention

Figure 1:
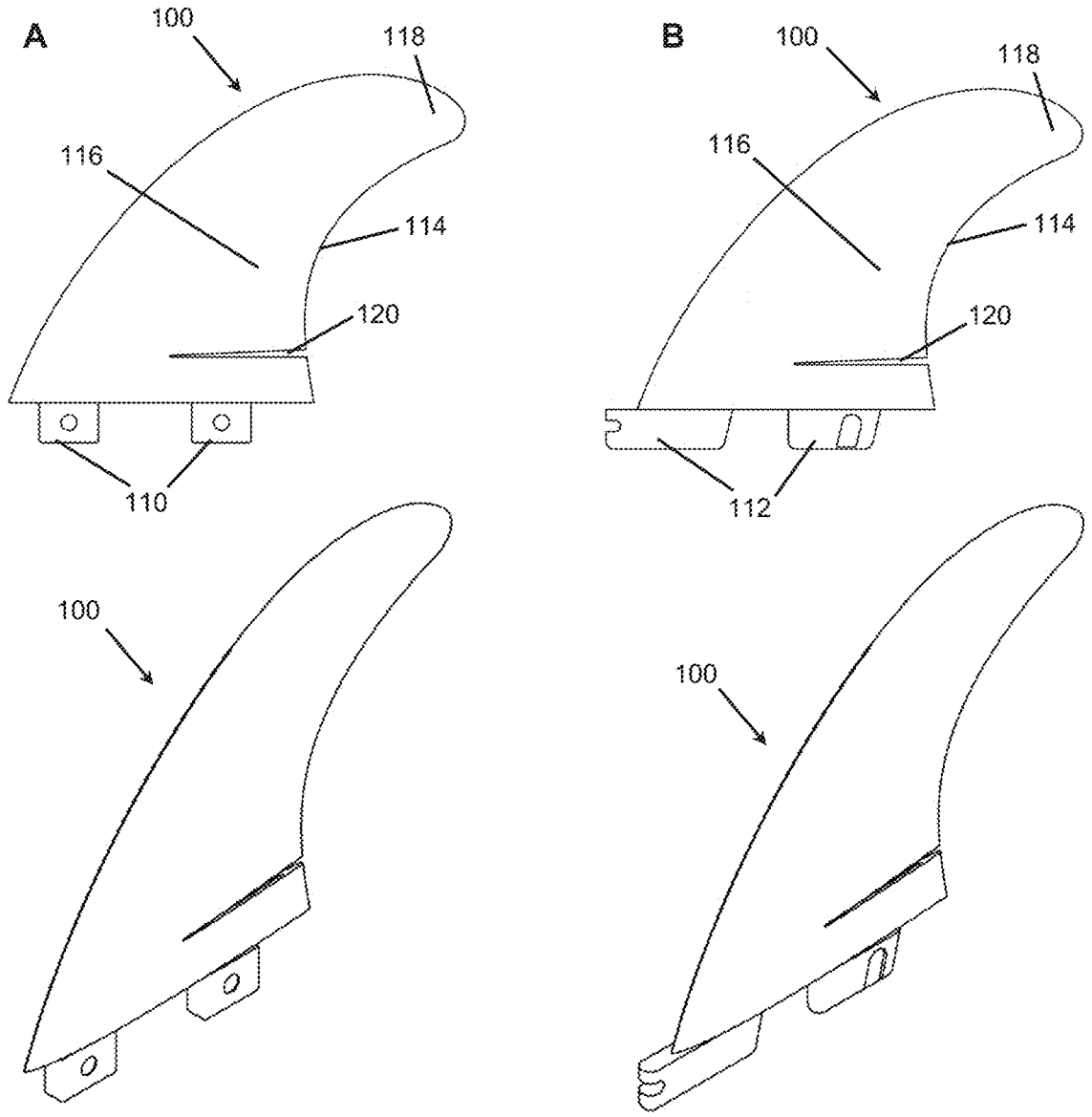
FIG. 1 illustrations of: (A) a side and perspective view of a preferred embodiment of a resiliently flexible fin according to the first aspect of the invention, with mounting blocks as the mounting means that can be releasably attached within FCS® II fin plugs or original FCS® fin plugs; and (B) a side and perspective view of a preferred embodiment of a resiliently flexible fin according to the first aspect of the invention, with mounting blocks that can be releasably attached within FCS® II fin plugs.
Figure 2:
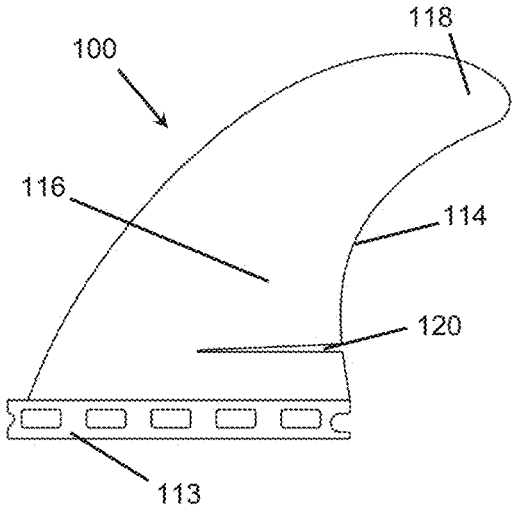
FIG. 2 illustrations of a (A) side and (B) perspective view of a preferred embodiment of a resiliently flexible fin according to the first aspect of the invention, with a mounting block that can be releasably attached within a Futures® fin box.
Figure 2:
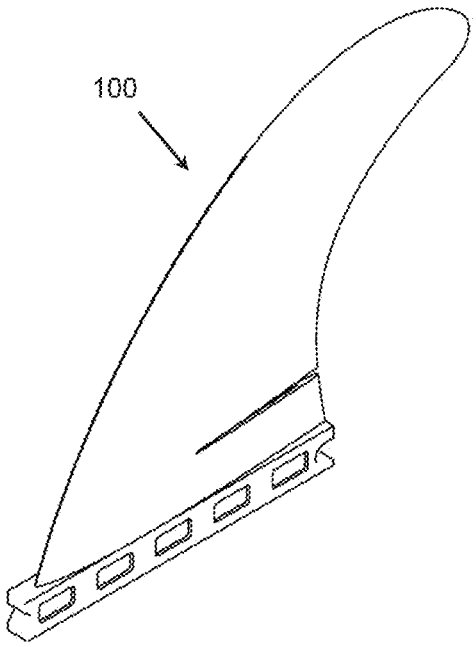

A preferred embodiment of the resiliently flexible fin according to the first aspect of the invention is shown in FIG. 1 and FIG. 2. The resiliently flexible fin 100 in FIG. 1A comprises mounting blocks 110 that can be releasably attached within original FCS® plugs or FCS® II plugs in a surfboard. The resiliently flexible fin 100 in FIG. 1B comprises mounting blocks 112 that can be releasably attached within FCS® II plugs in a surfboard. The resiliently flexible fin 100 in FIG. 2 comprises a mounting block 113 that can be releasably attached within a Futures® fin box in a surfboard.

A lateral cut 120 from the trailing edge 114 through a portion of the fin situated close to the mounting blocks enables the upper portion 116 of the fin above the cut (that is, on the opposite side of the cut to the mounting blocks 110/112/113) to resiliently flex upon normal forces experienced during a turn while surfing a wave on a surfboard to which the fin 100 is mounted. The resilient flexing of the upper portion 116 of the fin 100 is greatest towards the trailing edge 114 and the tip 118 of the fin 100. This aims to provide additional thrust and therefore speed for the surfboard on which the fin 100 is mounted as the flexed fin returns to its un-flexed configuration.

Figure 3:
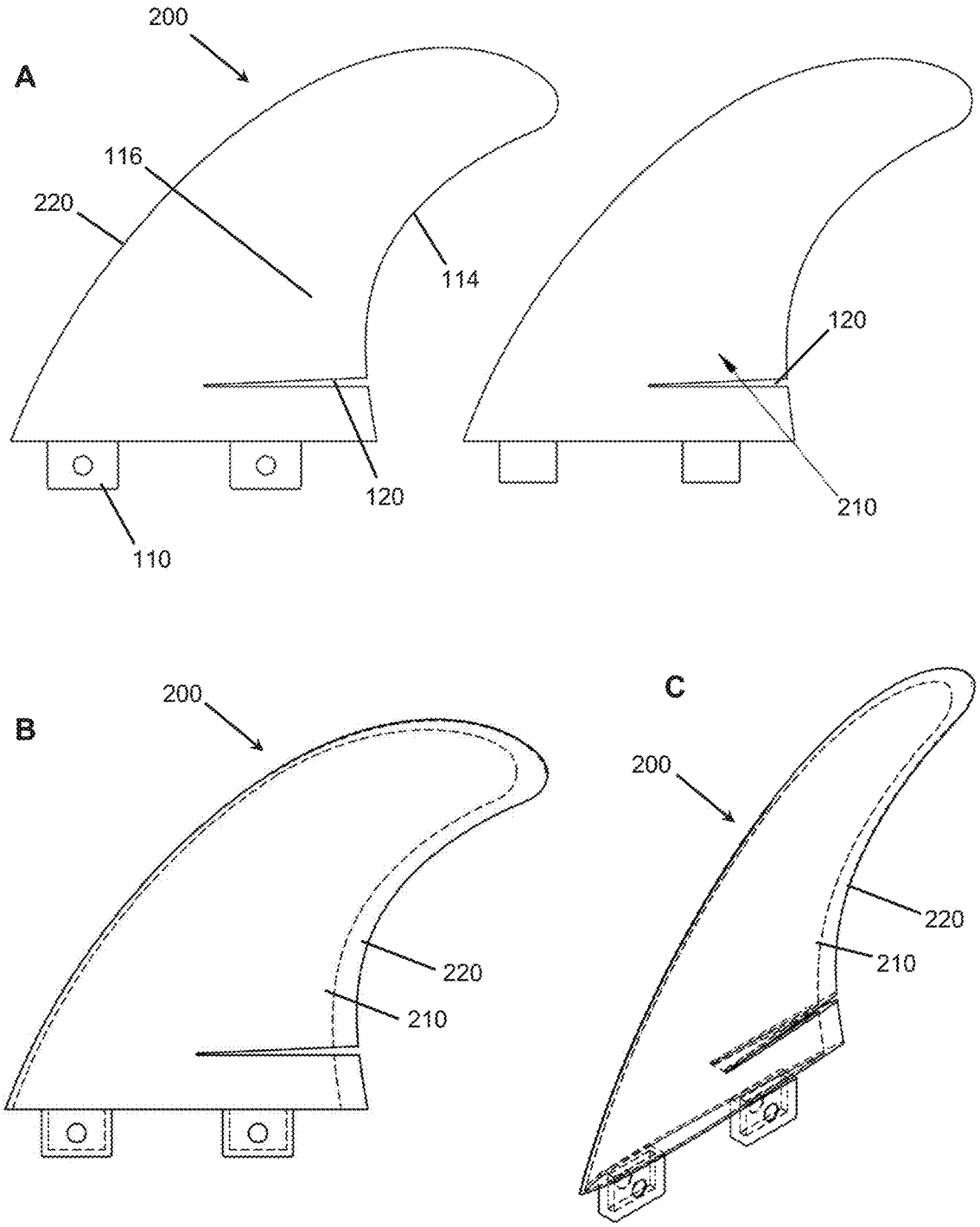
FIG. 3 illustrations of: (A) an exploded view, (B) a side view, and (C) a perspective view, of a preferred embodiment of a resiliently flexible fin with a titanium alloy core according to the first aspect of the invention, with mounting blocks that can be releasably attached within original FCS® fin plugs and FCS® II fin plugs.

A further preferred embodiment of the resiliently flexible fin of the invention is shown in FIG. 3. Similarly to the resiliently flexible fin shown in FIG. 1A, the resiliently flexible fin 200 of FIG. 2 comprises mounting blocks 110 that can be releasably attached within original FCS® plugs or FCS® II plugs in a surfboard, and a lateral cut 120 from the trailing edge 114 through a portion of the fin adjacent the base. However, this embodiment of the resiliently flexible fin 200 comprises a titanium alloy core 210 within the fin 200. FIG. 3A shows an exploded version of the fin 200 with the core 210 separated from the overmoulding, plastic, or resin cover 220.

As already described herein, the benefit of the titanium or titanium alloy core is to provide beneficial strength, flexibility and resilience to: (i) not break under the turning forces when in normal use, particularly with the cut 120 through the fin 200; (ii) allow the upper portion 116 of the fin 200 to flex with the turning forces the fin 200 is put under during normal use; and (iii) to return to the original configuration or shape once those turning forces have been removed.

In FIG. 3B and FIG. 3C, the outline of the titanium alloy core 201 within the resiliently flexible fin 200 is indicated by dashed lines.

Figure 4:
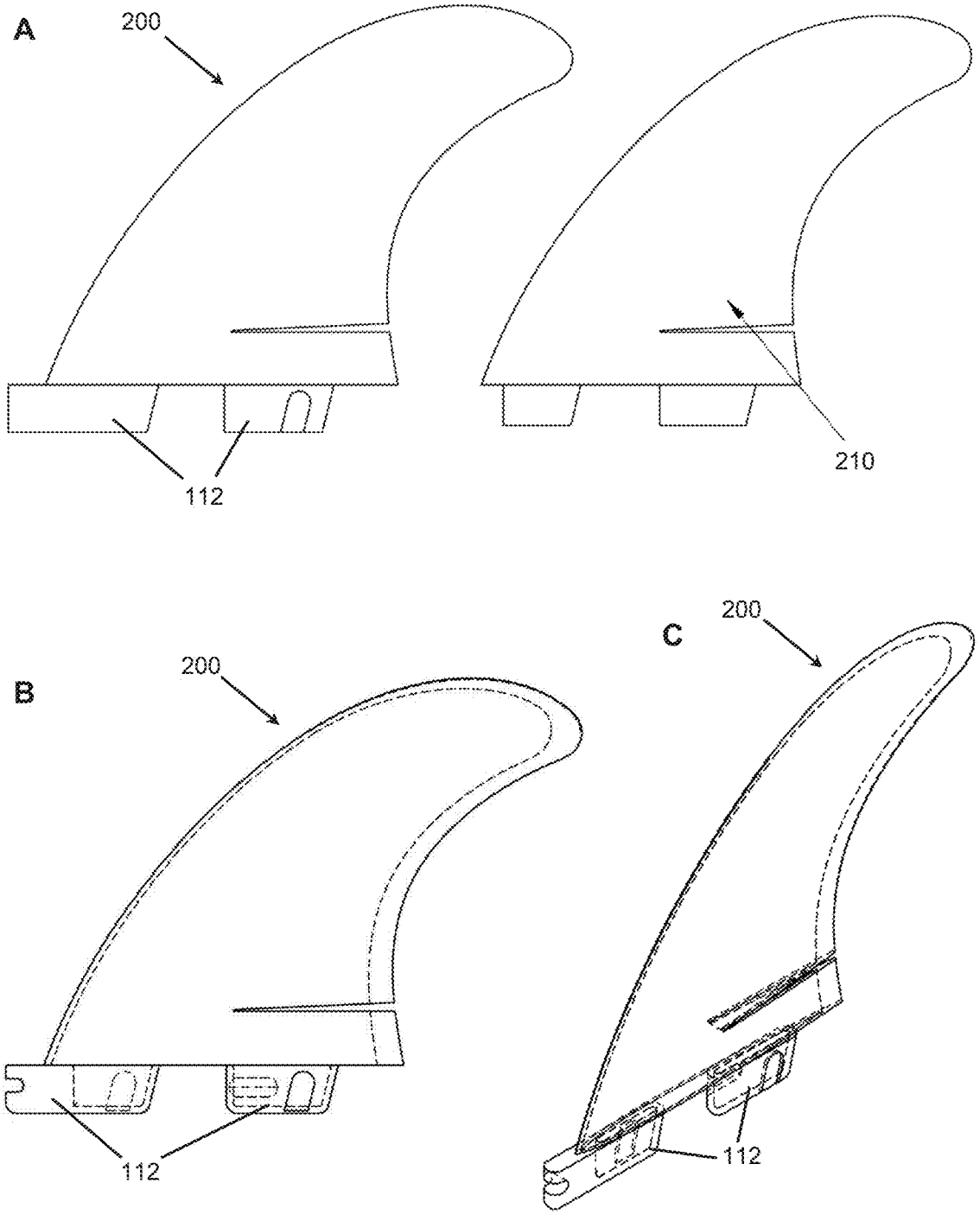
FIG. 4 illustrations of: (A) an exploded view, (B) a side view, and (C) a perspective view, of a preferred embodiment of a resiliently flexible fin with a titanium alloy core according to the first aspect of the invention, with mounting blocks that can be releasably attached within FCS® II fin plugs.

FIG. 4 shows a resiliently flexible fin similar to the fin shown in FIG. 3 except comprising mounting blocks 112 that can be releasably attached within FCS® II plugs in a surfboard.

Figure 5:
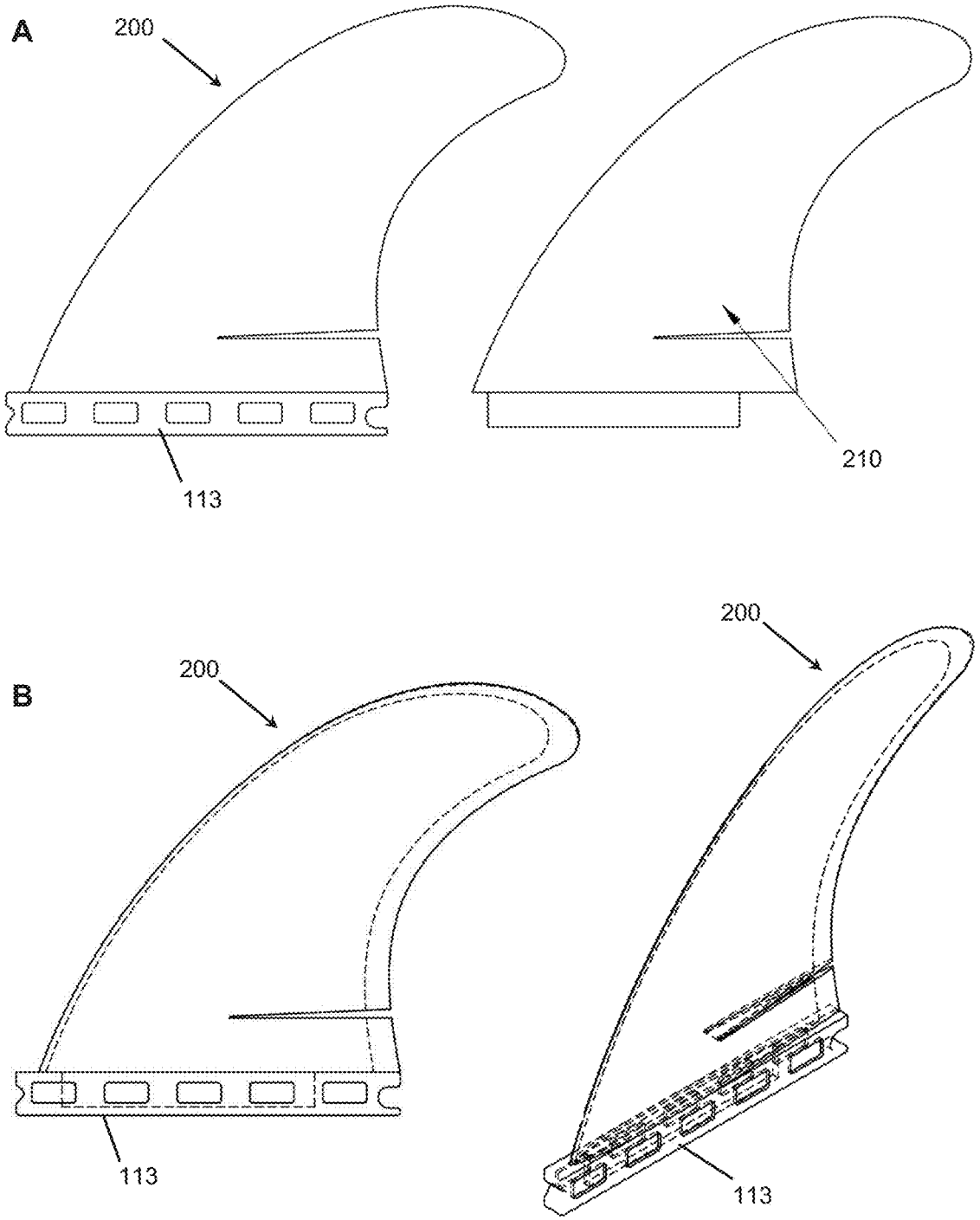
FIG. 5 illustrations of: (A) an exploded view, (B) a side view, and (C) a perspective view, of a preferred embodiment of a resiliently flexible fin with a titanium alloy core according to the first aspect of the invention, with a mounting block that can be releasably attached within a Futures® fin box.

FIG. 5 shows a resiliently flexible fin similar to the fin shown in FIG. 3 and FIG. 4 except comprising a mounting block 113 that can be releasably attached within a Futures® fin box in a surfboard.

Figure 6:
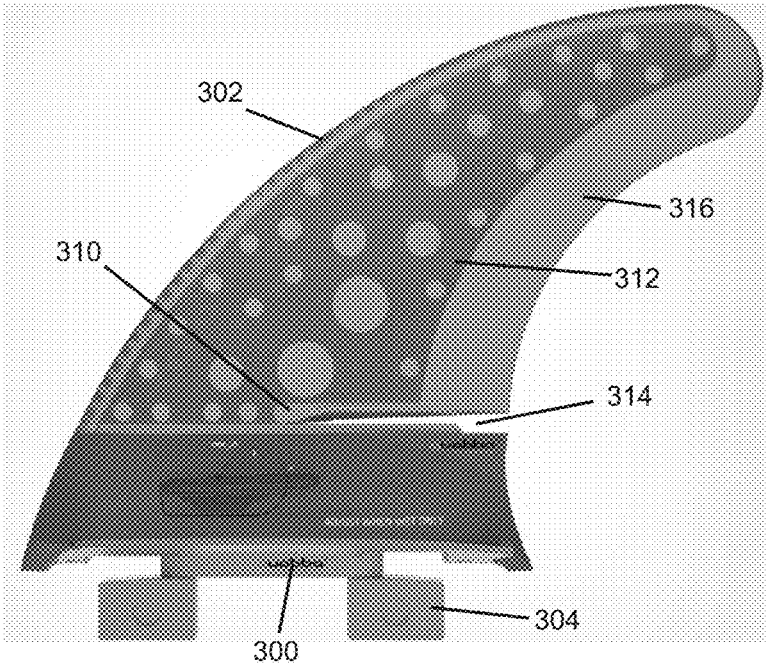
FIG. 6 computer generated images of: (A) a side, and (B) a perspective view, of a preferred embodiment of an adjustable, resiliently flexible fin according to the first aspect of the invention, with mounting blocks that can be releasably attached within FCS® II fin plugs or original FCS® fin plugs.
Figure 6:
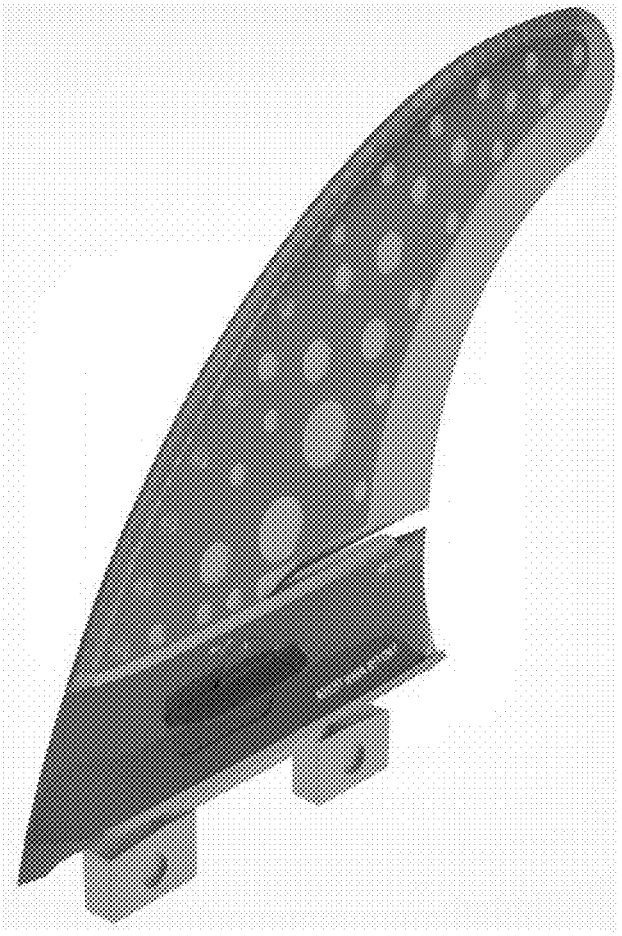
Figure 7:
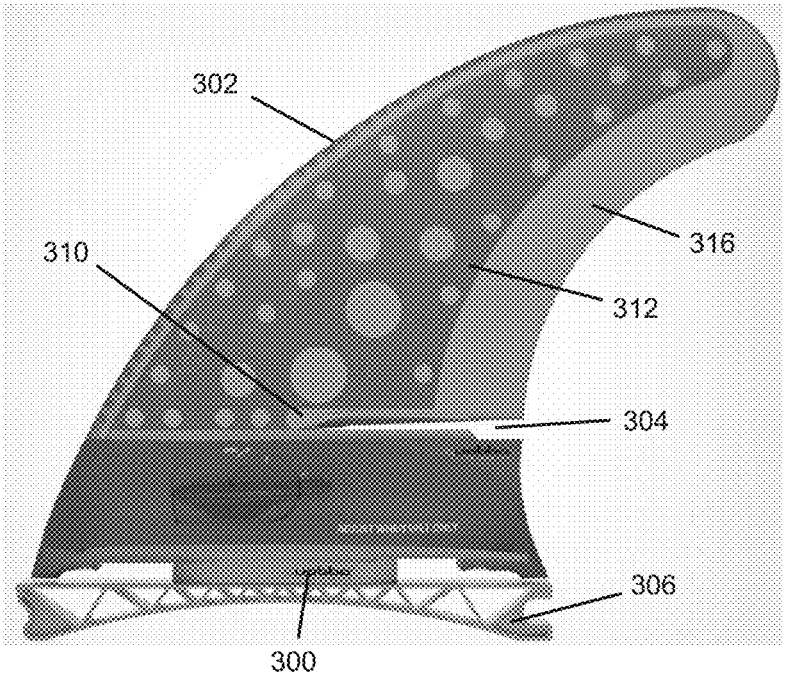
FIG. 7 computer generated images of: (A) a side, and (B) a perspective view, of a preferred embodiment of an adjustable, resiliently flexible fin according to the first aspect of the invention, with a mounting block that can be releasably attached within a Futures® fin box.
Figure 7:
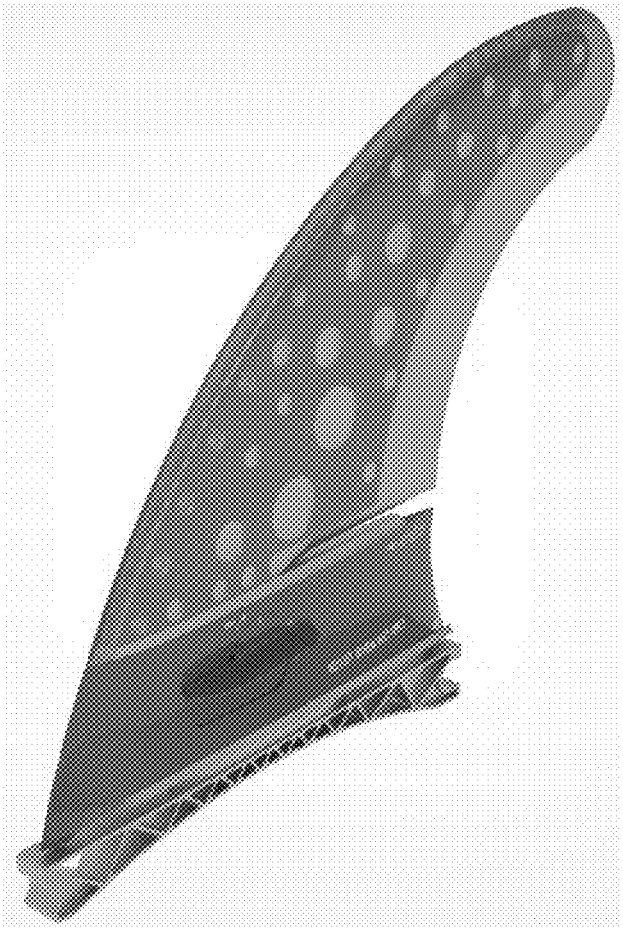
Figure 8:
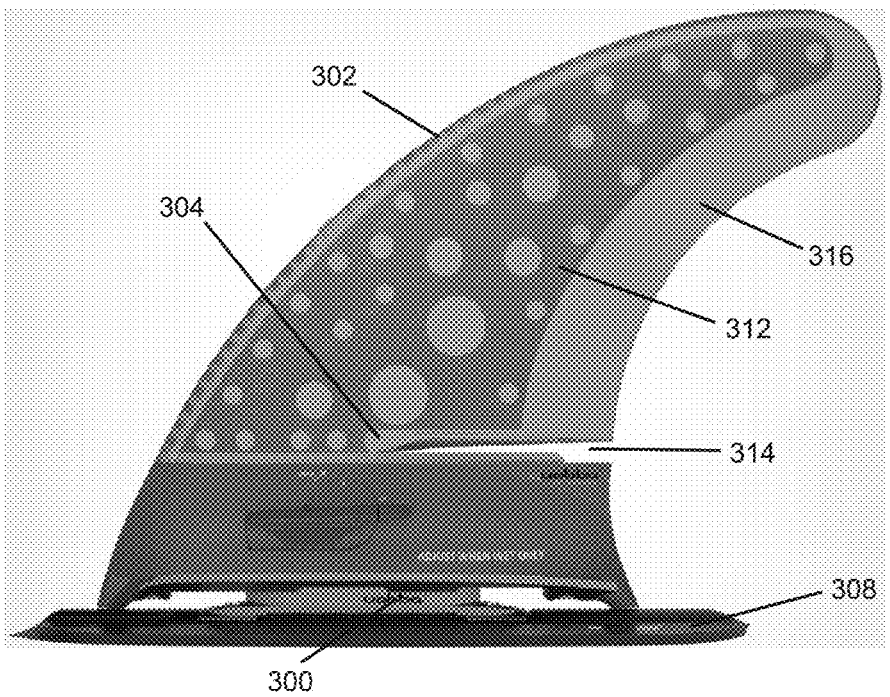
FIG. 8 computer generated images of: (A) a side, and (B) a perspective view, of a preferred embodiment of an adjustable, resiliently flexible fin according to the first aspect of the invention, with a flat base for mounting the fin to a surfboard.
Figure 8:
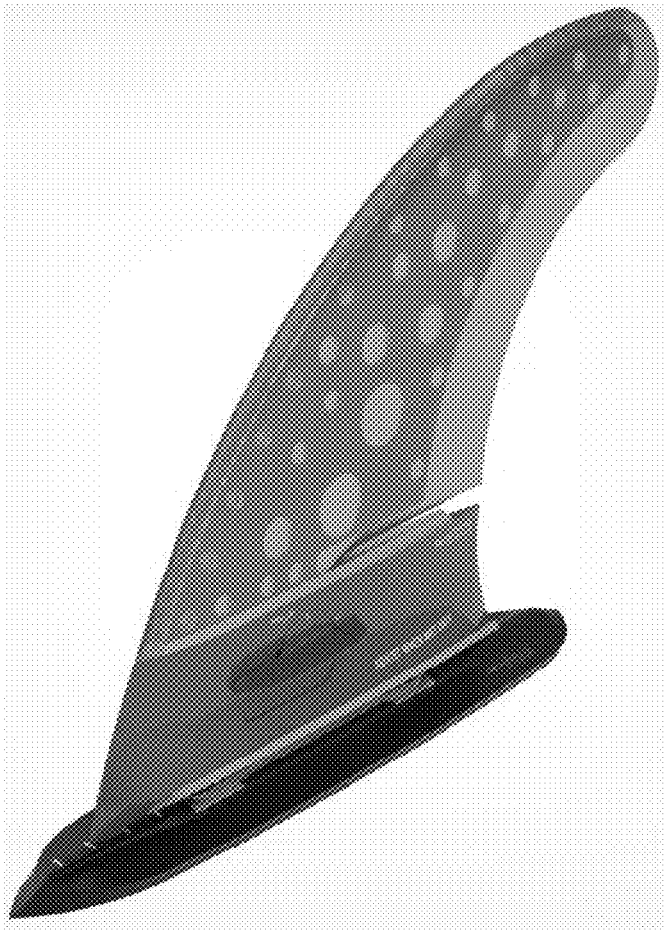

Further preferred embodiments of the resiliently flexible fin of the invention are shown in FIG. 6, FIG. 7, and FIG. 8. Each of these embodiments comprises a base portion 300 which is releasably attached to, and adjustable with, the fin 302, and the base portions 300 comprise either:

mounting blocks 304 that can be releasably attached within original FCS® plugs or FCS® II plugs in a surfboard (FIG. 6), a mounting block 306 that can be releasably attached within a Futures® fin box in a surfboard (FIG. 7), or a flat base 308 (FIG. 8) for mounting the resiliently flexible fin to a surfboard. These embodiments also comprise a lateral core cut 310 through a portion of the titanium alloy core 312, in addition to a cut 314 through the transparent overmoulding 316 covering the core 312.

Figure 9:
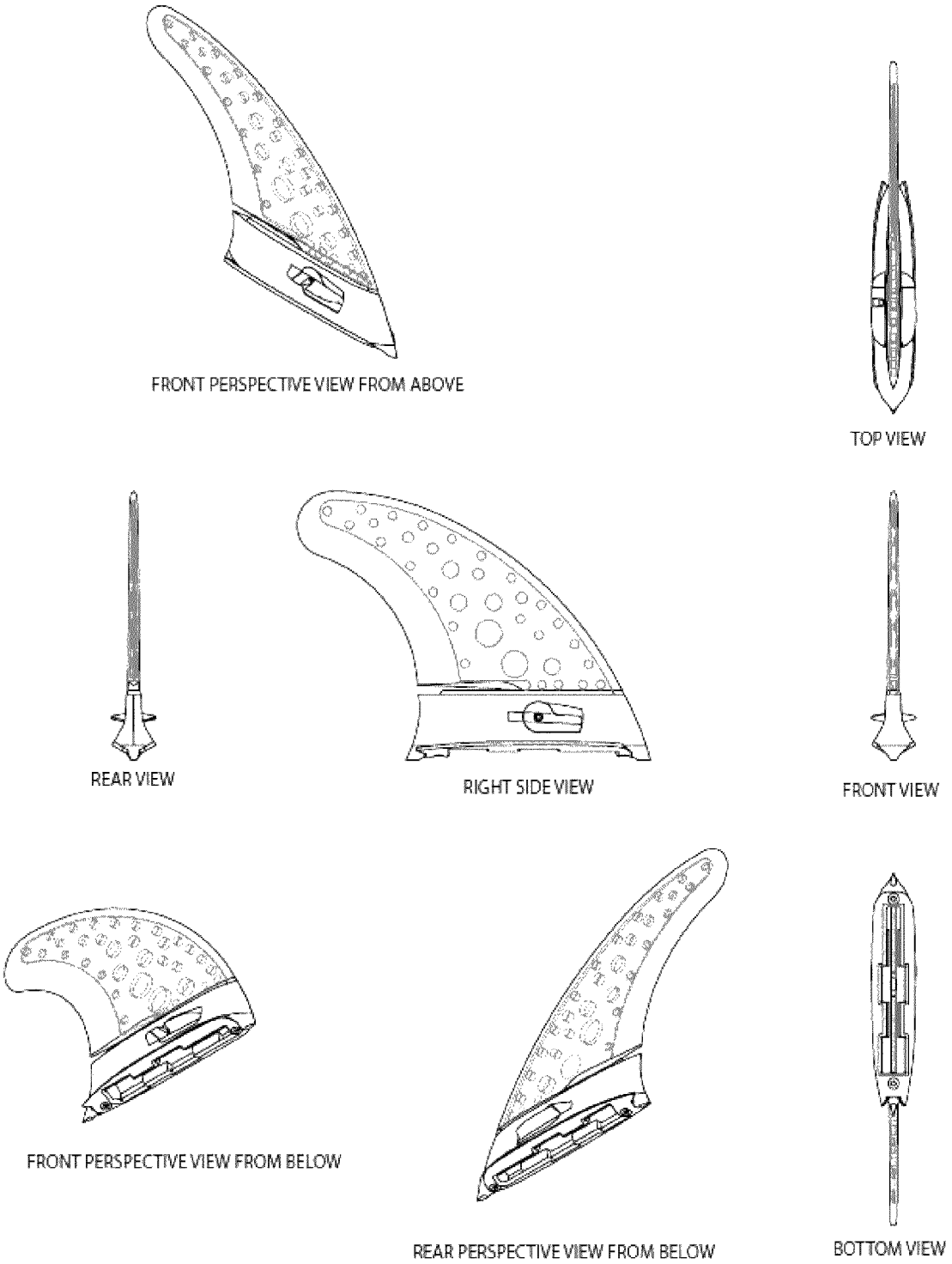
FIG. 9 illustrations of different views of a preferred embodiment of an adjustable, resiliently flexible fin excluding the base, according to the first aspect of the invention.

FIG. 9 shows different views of line drawing illustrations of a fin, excluding the base portion, according to the preferred embodiments in FIG. 6, FIG. 7, and FIG. 8.

Figure 10:
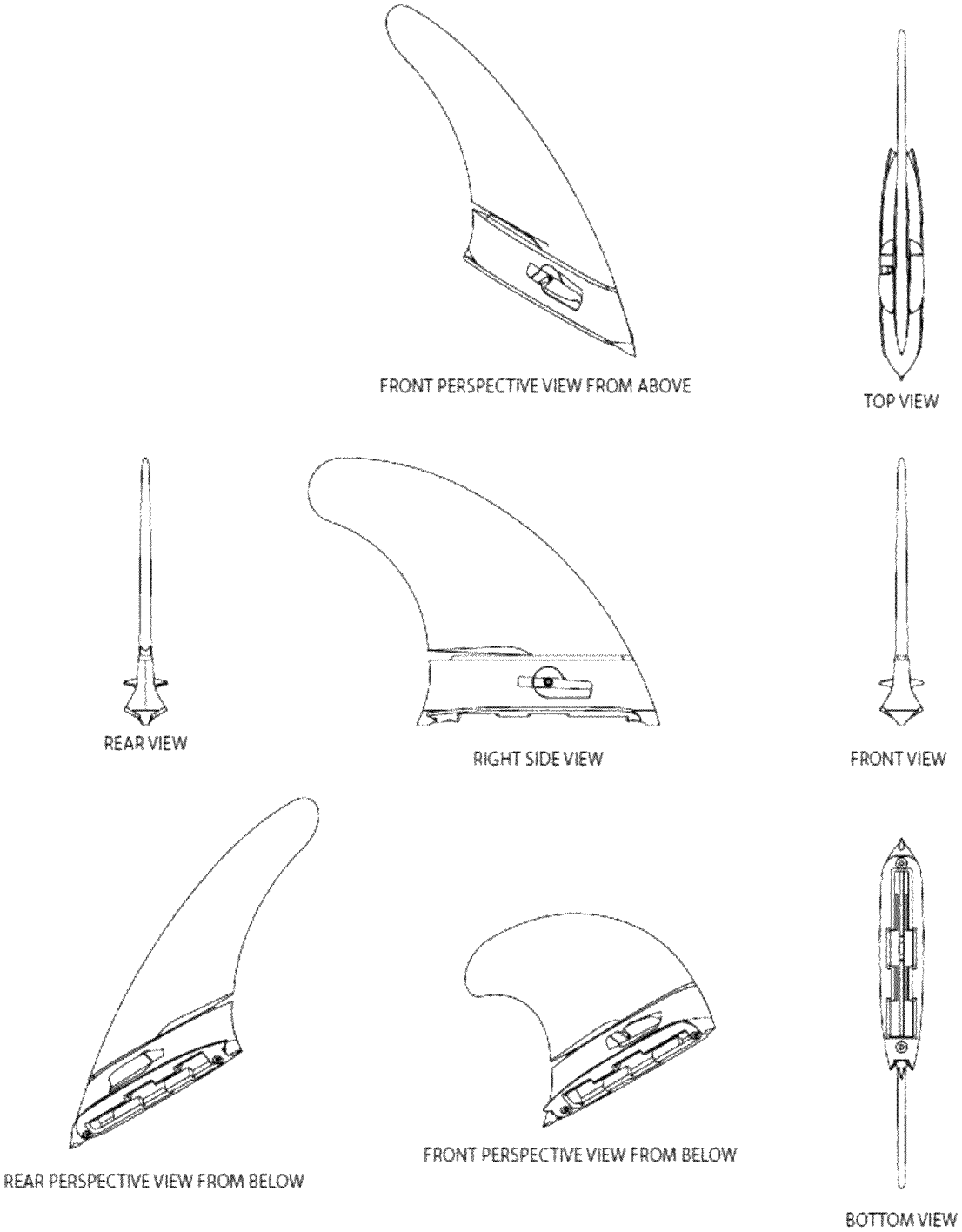
FIG. 10 illustrations of different views of a preferred embodiment of an adjustable, resiliently flexible fin excluding the base, according to the first aspect of the invention with an opaque overmoulding so the core is not visible.

FIG. 10 shows different views of line drawing illustrations of a fin, excluding the base portion, similar to the embodiment shown in FIG. 9 except the titanium alloy core cannot be seen beneath a flexible overmoulding cover that is opaque.

Second Aspect of the Invention

Figure 11:
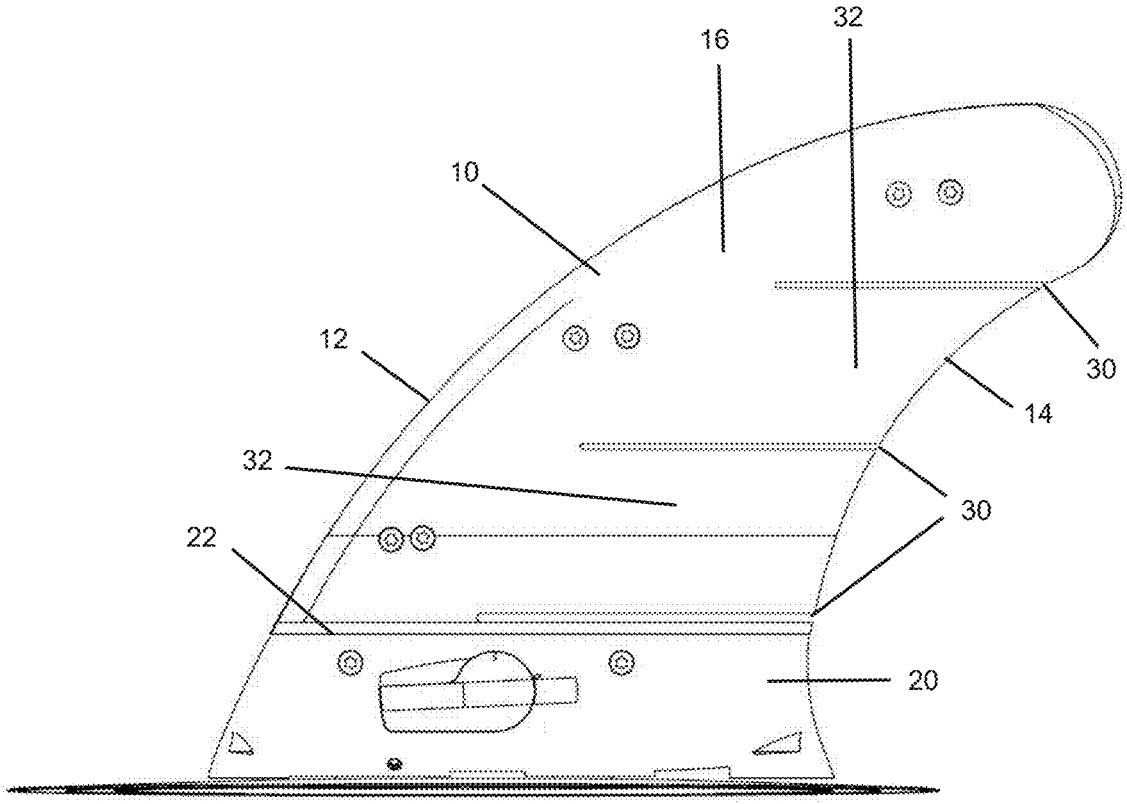
FIG. 11 illustration of a side view of a preferred embodiment of the resiliently flexible fin according to the second aspect of the invention.

A preferred embodiment of a flexible fin according to the second aspect of the invention is shown in FIG. 11. The fin section 10 comprises a leading edge 12 and a trailing edge 14 and outer fin surfaces 16 of which only one is visible in the side view of FIG. 11. The fin section 10 is attached to the fin base 20 at the base attachment surface 22

Three lateral cuts 30 approximately two thirds through the fin section 10 begin at the trailing edge 14 and are substantially parallel to the base attachment surface 22. The cuts 30 form resiliently flexible trailing edge flaps 32. When the flexible fin is mounted onto a surfboard, a rider turning the surfboard during normal use will cause forces applied by the water to flex the trailing edge flaps 32. Without wanting to be limited by theory, it is understood that as the surfboard and rider is exiting the turn, the resilient trailing edge flaps 32 return to their original position (and even momentarily beyond) with the reduction and release of those water forces. The strength and resilience of the titanium or titanium alloy core 40 when returning to the original position causes a direct force on the water in the substantially opposite direction giving the surfboard and rider additional speed at the end of the turn in a substantially forward direction. These resilient trailing edge flaps 32 are considered by the inventor to replicate the effect of a hinged door-like effect. This is particularly beneficial if the turn is a bottom turn up toward the lip of a wave wherein the additional speed generated by the trailing edge flaps 32 can assist the surfboard and rider further into the air above the lip to perform an aerial manoeuvre.

Figure 12:
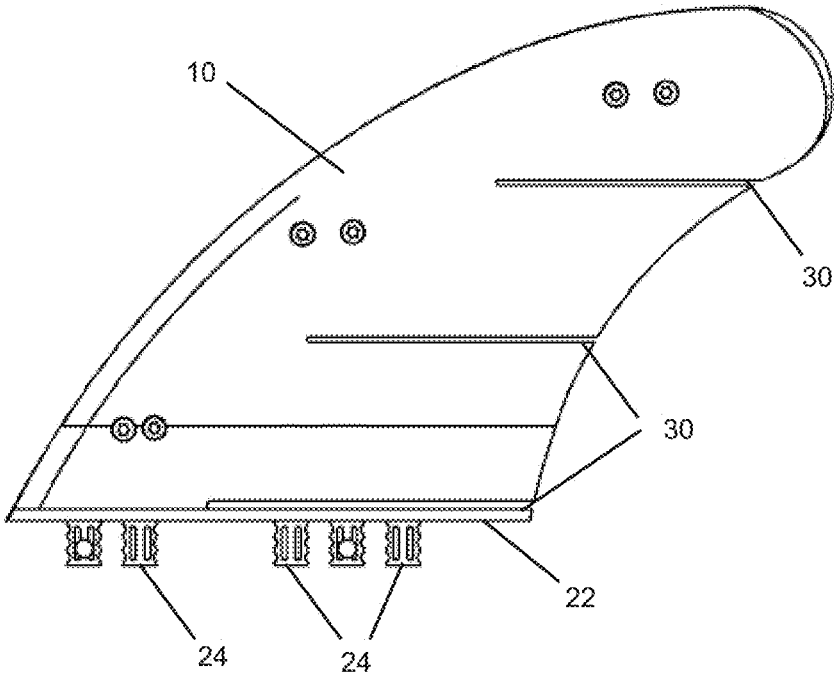
FIG. 12 illustration of an exploded side view of a preferred embodiment of the resiliently flexible fin according to the second aspect of the invention.
Figure 12:
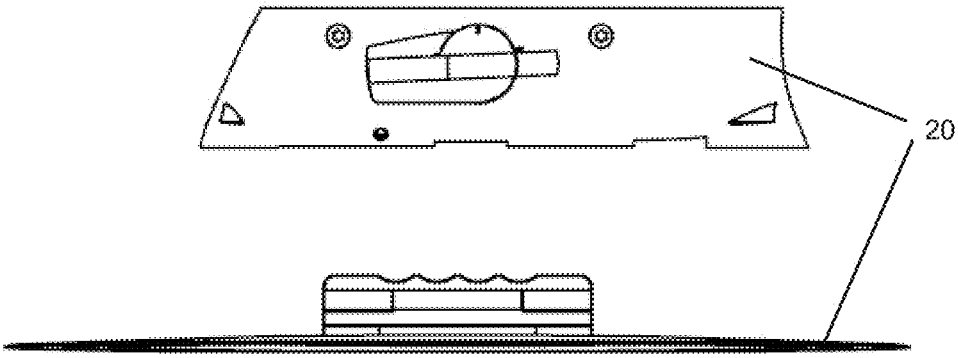

The preferred embodiment of the flexible fin according to the second aspect of the invention is shown in an exploded form in FIG. 12. The fin section 10 comprising the cuts 30 is attached to the fin base 20 at the base attachment surface 22 with base attachment tabs 24 which fit into accommodating slots in the top of the fin base 20. The fin section 10 may be permanently attached to the fin base 20 or releasably attachable so the fin sections may be interchanged with a different fin section, for example, that has a different fin template. Alternatively, fin sections according to the invention having different fin templates may be attached to the same type of fin base during manufacture. The fin base 20 in the preferred embodiment comprises at least two distinct portions.

Figure 13:
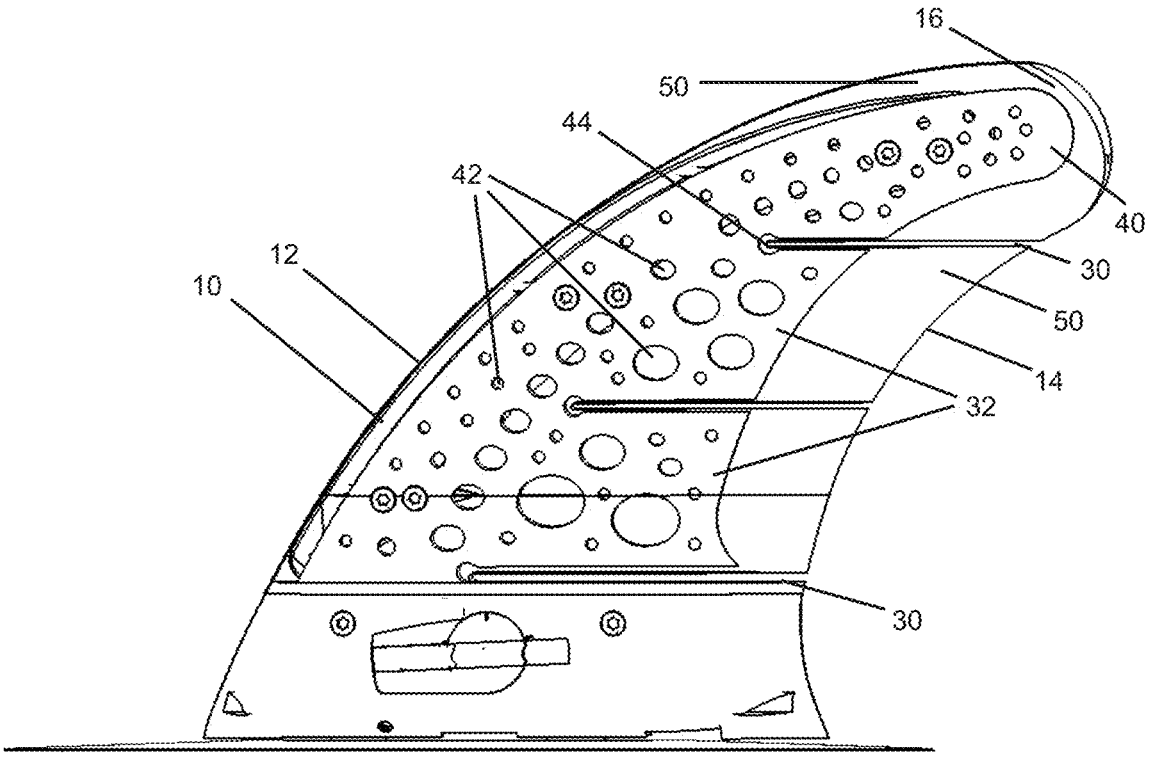
FIG. 13 illustration of a side view of a preferred embodiment of the resiliently flexible fin according to the second aspect of the invention with translucent overmoulding making the core visible through the overmoulding.

The fin section 10 comprises a core 40 of titanium or titanium alloy which is covered by a flexible over-moulding 50 as shown in FIG. 13. The core 40 in the preferred embodiment comprises a plurality of circular or oval holes 42. A first purpose of these holes 42 is to assist the flexibility of the titanium or titanium alloy core 40. In this regard, the holes 42 are relatively small adjacent to the leading edge 12 and are larger in size towards the trailing edge 14. This creates a stronger and stiffer core 40 in the vicinity of the leading edge 12 and enables greater flexibility of the core 40 adjacent the trailing edge. The largest holes 42 in the core 40 are within the trailing edge flaps 32 which provides this region of the fin section with the greatest flexibility. An additional benefit is a reduction in the weight of the core (although the titanium and titanium alloy core is not heavy relative to the other materials fins are usually constructed from), as well as a reduction in the amount of costly titanium or titanium alloy required to form the core 40.

The flexible overmoulding 50 covers the core 40 and forms the template of the fin section 10. A portion of overmoulding 50 at the leading edge 12 and fin tip 16 covers the core 40 to maintain the safety of the surfboard rider and other persons that could potentially come into contact with the leading edge 12 or fin tip 16 of the flexible fin of the invention when in use.

The overmoulding 50 does not cover the base attachment surface 22, base attachment tabs 24, or any other base mounting means. Instead the core 40 attaches to the fin base 20.

A second purpose for the holes 42 in the core 40 is that they are filled with overmoulding 50 providing strong attachment between the core 40 and overmoulding 50.

A cut 30 begins through overmoulding 50 from the trailing edge 14 and passes through a portion of the core 40 until the cut 30 ends at a cut end hole 44. Finishing the cut in a cut end hole 44 reduces the potential for unwanted lengthening of the cut 30 further into the core 40 during use of the flexible fin.

Figure 14:
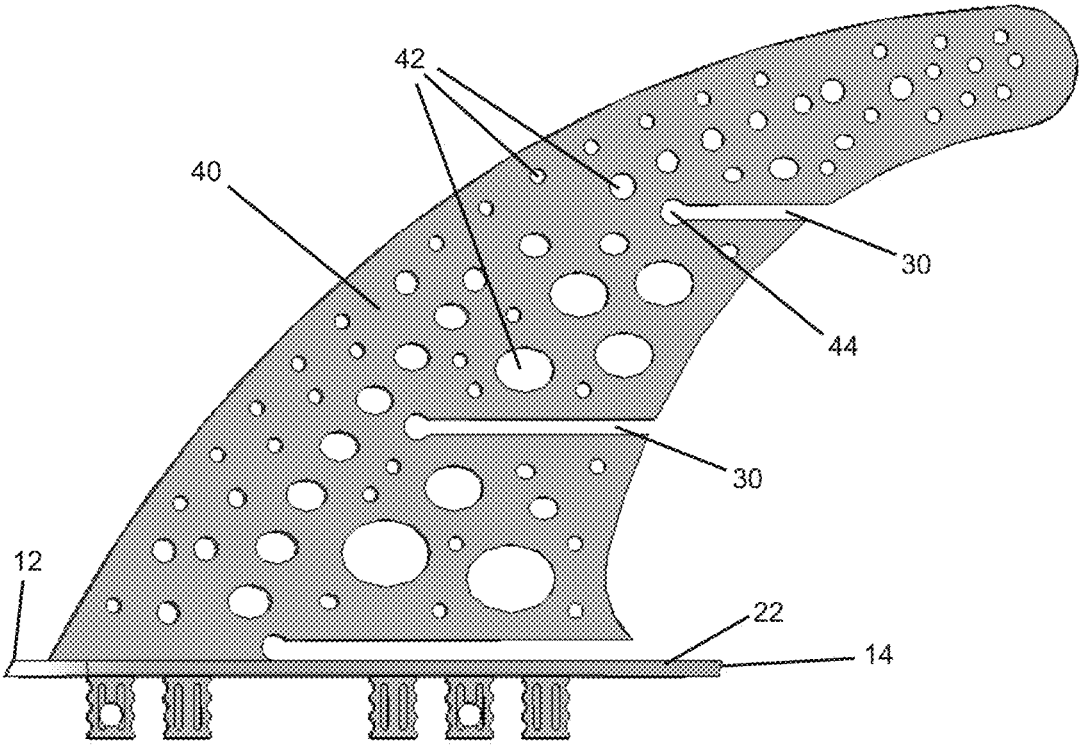
FIG. 14 illustration of a side view of a preferred embodiment of the core of a fin section according to the second aspect of the invention.

FIG. 14 shows just the titanium or titanium alloy core 40 which highlights that the base attachment surface 22 extends to the leading edge 12 and trailing edge 14 of the fin section 10. It also more clearly shows the increasing size of the holes 42 towards the trailing edge 14.

Figure 15:
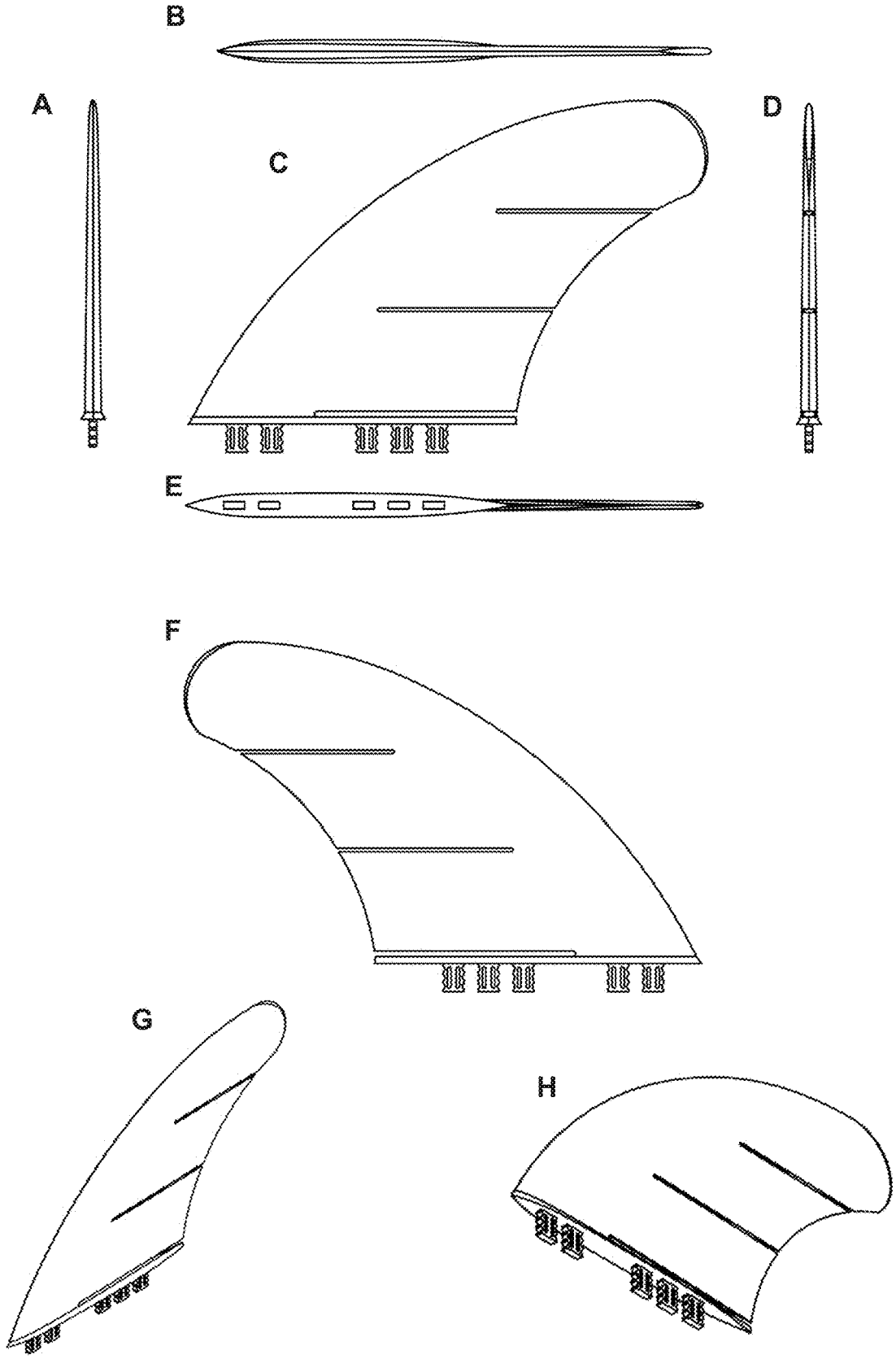
FIG. 15 illustrations of: (A) a front view, (B) a top view, (C) a left side view, (D) a rear view, (E) a bottom view, (F) a right side view, (G) a first perspective view, and (H) a second perspective view of a fin section according to an embodiment of the second aspect of the invention.

FIG. 15 shows alternative views of a fin section according to an embodiment of the invention according to the second aspect with opaque overmoulding so that the core is not visible.

Third Aspect of the Invention

Figure 16:
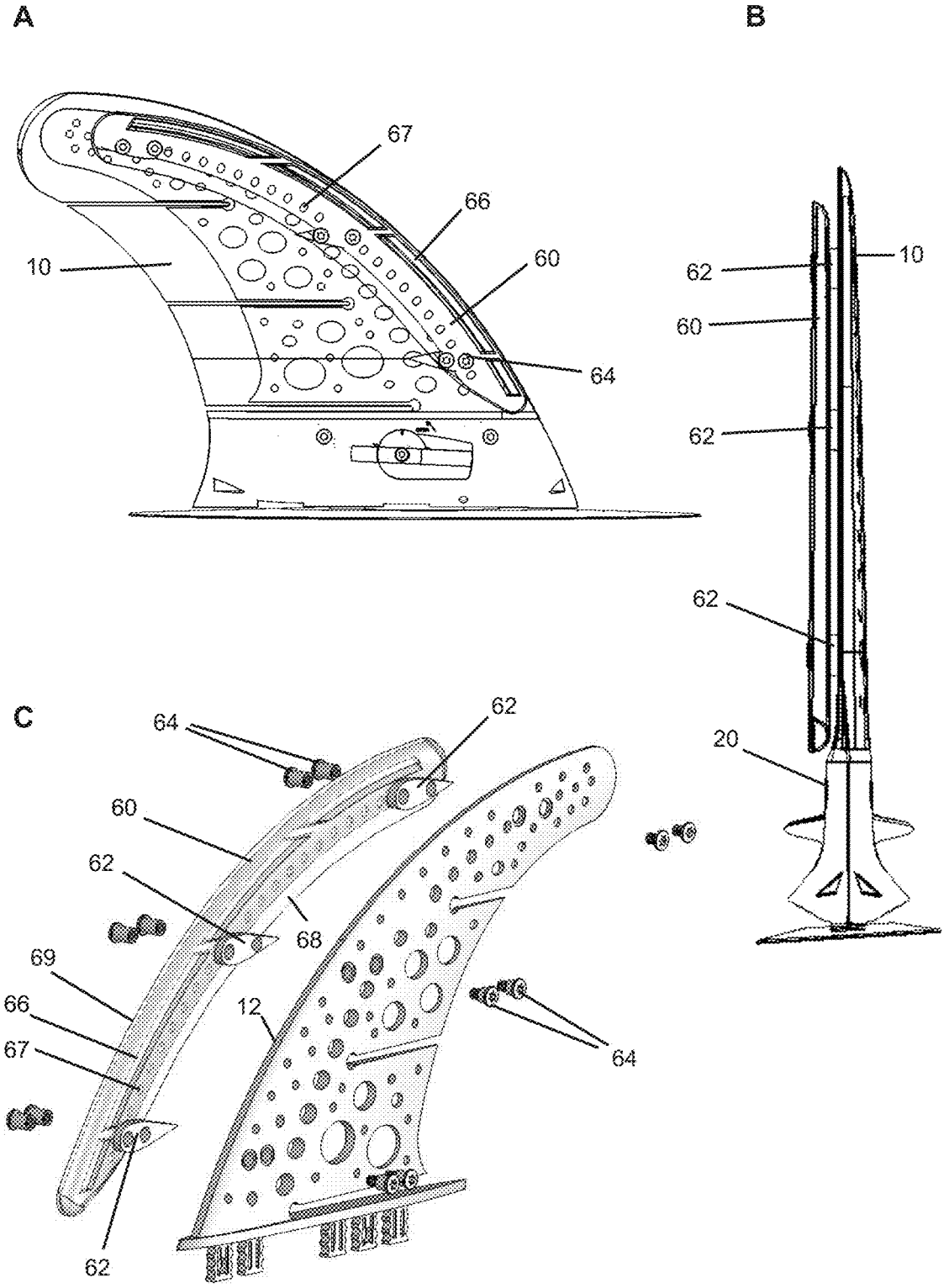
FIG. 16 illustrations of: (A) a side view, (B) a front view, and (C) an exploded perspective view of a dual fin according to the third aspect of the invention.

A preferred embodiment of the flexible fin according to the third aspect of the invention is shown in FIG. 16, wherein a second fin section 60 is attached to the fin section 10 by an attachment means. The attachment means in this embodiment are in the form of three ribs 62 configured in the shape of a cross section of a foil, which are attached to the second fin section 60. The ribs 62 form a thin gap between the fin section 10 and the second fin section 60 through which water can pass during normal use. The second fin section 60 has a thinner template than the fin section 10 with the whole second fin section 60 located adjacent the leading edge 12 of the fin section 10. The second fin section 60 is attached to the fin section 10 by two screws 64 through each rib 62 and the two screws pass through holes in the fin section 10. Openings in the form of a gap 66 and holes 67 in the second fin section allow water to pass through the second fin section 60 during normal use and direct that water to the area adjacent the trailing edge 68 of the second fin section 60. Without wanting to be limited by theory, it is understood that increased pressure in this area due to the additional water directed into this area, when compared to the lower pressure adjacent the leading edge 12 of the fin section 10 and the leading edge 69 of the second fin section 60, causes thrust in a direction towards the area of lower pressure and therefore the leading edge 12 of the fin section 10 and the front of the surfboard.

The claims defining the invention are as follows:

1. A resiliently flexible fin comprising:

two outer fin surfaces which meet at a leading edge and a trailing edge;

a mounting means for mounting the fin onto a surfboard;

a core comprising metal or metal alloy;

a flexible cover over at least a portion of the core; and an opening at the trailing edge through a portion of the fin;

wherein the core comprises apertures, recesses, and/or cavities and the apertures, recesses, and/or cavities are filled with flexible cover.

2. The resiliently flexible fin according to claim 1, wherein the metal is titanium and the metal alloy is titanium alloy and the titanium alloy comprises between approximately 3.5% to 4.5% vanadium, and between approximately 5.5% to 6.75% aluminium.

3. The resiliently flexible fin according to claim 1, wherein the opening at the trailing edge through a portion of the fin section is a cut.

4. The resiliently flexible fin according to claim 3, wherein the cut is a substantially lateral cut.

5. The resiliently flexible fin according to claim 3, wherein the cut is adjacent to the mounting means.

6. The resiliently flexible fin according to claim 3, wherein the cut is substantially parallel to the mounting means.

7. The resiliently flexible fin according to claim 1, wherein the opening is through a portion of the core.

8. The resiliently flexible fin according to claim 1, wherein the portion of the fin on the opposite side of the opening to the mounting means can resiliently flex.

9. The resiliently flexible fin according to claim 1, wherein the flexible cover is a flexible overmoulding.

10. The resiliently flexible fin according to claim 1, wherein the mounting means are mounting blocks capable of attaching to commercially available fin plug and fin box systems.

11. The resiliently flexible fin according to claim 1, wherein in use, forces exerted by water on an outer fin surface when a rider of a surfboard on which the fin is mounted forces the surfboard to turn, flexes the portion of the fin on the opposite side of the opening to the mounting means, and upon release of the force exerted by the water as the surfboard exits the turn, the resilience of the metal or metal alloy core displaces water in its path as it returns the fin to its non-flexed configuration providing additional forward thrust for the surfboard.

12. The resiliently flexible fin according to claim 1, comprising a fin section releasably or permanently attached to a fin base portion, wherein the fin section comprises the opening and the fin base portion comprises the mounting means for mounting the fin onto a surfboard.

13. The resiliently flexible fin according to claim 1 for mounting to any one of the boards in the group comprising: surfboard, shortboard, kneeboard, longboard, minimal, soft board, kiteboard, wind surfer, stand up paddleboard, wakeboard, rescue board, bodyboard, or another board used in surface water sports or activities.

14. The process comprising the step of mounting a resiliently flexible fin according to claim 1 to any one of the boards in the group comprising: surfboard, shortboard, kneeboard, longboard, minimal, soft board, kiteboard, wind surfer, stand up paddleboard, wakeboard, rescue board, bodyboard, or another board used in surface water sports or activities.

* * * * *